US012742574B2

(12) United States Patent
Shanmugam et al.

(10) Patent No.: US 12,742,574 B2
(45) Date of Patent: Sep. 22, 2026

(54) $CO_2$ REFRIGERATION SYSTEM WITH SUPERHEAT CONTROL

(71) Applicant: Hill Phoenix, Inc., Conyers, GA (US)

(72) Inventors: Senthilkumar Kandappa Goundar Shanmugam, Covington, GA (US); Alireza Behfar, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 15 days.

(21) Appl. No.: 18/669,803

(22) Filed: May 21, 2024

(65) Prior Publication Data

US 2025/0362062 A1 Nov. 27, 2025

(51) Int. Cl.

*F25B 9/00* (2006.01)
*F25B 40/04* (2006.01)
*F25B 41/20* (2021.01)

(52) U.S. Cl.

CPC ..... *F25B 9/008* (2013.01); *F25B 40/04* (2013.01); *F25B 41/20* (2021.01); *F25B 2309/061* (2013.01); *F25B 2400/0409* (2013.01); *F25B 2400/075* (2013.01); *F25B 2400/16* (2013.01); *F25B 2400/22* (2013.01); *F25B 2600/21* (2013.01); *F25B 2600/2501* (2013.01)

(58) Field of Classification Search

None

See application file for complete search history.

(56) References Cited

U.S. PATENT DOCUMENTS 11,029,068 B2 6/2021 Christensen et al.
11,243,016 B2 2/2022 Khaled et al.
11,353,246 B2 * 6/2022 Hayes ..... F25B 9/008
11,692,742 B1 * 7/2023 Vaisman ..... F25B 41/345 62/117
11,732,938 B2 8/2023 Khaled et al.
12,055,327 B2 8/2024 Khaled et al.

(Continued)

FOREIGN PATENT DOCUMENTS

CN 105841380 B * 6/2020 ..... F25B 41/40
WO WO-2014199788 A1 * 12/2014 ..... F25B 13/00

OTHER PUBLICATIONS

Extended European Search Report in European Appln. No. 25175872.8, mailed on Oct. 23, 2025, 9 pages.

*Primary Examiner* — Jenna M Maroney
*Assistant Examiner* — Gustavo A Hincapie Serna
(74) *Attorney, Agent, or Firm* — Fish & Richardson P.C.

(57) ABSTRACT

A transcritical refrigeration system includes a gas cooler/condenser; a receiver configured to collect refrigerant produced by the refrigeration system; a gas bypass valve fluidly coupled to the outlet of the receiver and operable to control a pressure of the refrigerant in the receiver; and a medium temperature subsystem. The medium temperature subsystem includes one or more expansion valves; one or more medium temperature evaporators; and a suction group including one or more transcritical compressors operable to compress gas refrigerant and discharge the compressed gas refrigerant into a discharge line. The system includes a superheat control system that includes a heat exchanger system including a first side configured to carry gas refrigerant passing between the gas cooler/condenser and an inlet of the receiver, and a second side in heat transfer communication with the first side.

26 Claims, 7 Drawing Sheets

(56) References Cited

U.S. PATENT DOCUMENTS 12,097,451 B2 * 9/2024 Prins ..... F25B 49/02
12,228,313 B2 * 2/2025 Aschow ..... F25B 9/008
12,516,851 B2 * 1/2026 Iyoshi ..... F25B 7/00
12,516,860 B2 * 1/2026 Javerschek ..... F25B 49/022
12,613,057 B2 * 4/2026 Groenewald ..... F25B 5/02
2010/0132399 A1 * 6/2010 Mitra ..... B60H 1/3228 62/512
2011/0083456 A1 4/2011 Wakamoto et al.
2012/0192579 A1 * 8/2012 Huff ..... B60H 1/3228 62/115
2013/0091891 A1 * 4/2013 Hinde ..... F25B 7/00 62/470
2014/0151015 A1 * 6/2014 Sun ..... F25B 41/00 62/190
2014/0208785 A1 * 7/2014 Wallace ..... F25B 49/02 62/190
2014/0352343 A1 * 12/2014 Hinde ..... F25B 7/00 62/277
2015/0345835 A1 * 12/2015 Martin ..... F25B 15/006 62/238.3
2016/0102901 A1 4/2016 Christensen et al.
2016/0363356 A1 * 12/2016 Hinde ..... F25B 31/004
2018/0195781 A1 * 7/2018 Saunders ..... F25B 31/00
2018/0216851 A1 * 8/2018 Christensen ..... F25B 1/10
2018/0340719 A1 * 11/2018 Rona ..... F25B 31/008
2019/0072299 A1 * 3/2019 Najafifard ..... F25B 7/00
2019/0078818 A1 * 3/2019 Khaled ..... F25B 40/02
2019/0368786 A1 * 12/2019 Newel ..... F25B 25/00
2020/0033039 A1 * 1/2020 Krishnamoorthy ..... F25B 41/20
2020/0064037 A1 * 2/2020 Ferretti ..... F25B 41/31
2020/0124330 A1 * 4/2020 Hayes ..... F25B 40/06
2020/0182515 A1 * 6/2020 Lesage ..... F25B 1/10
2020/0191446 A1 * 6/2020 Lesage ..... F25B 9/10
2021/0348811 A1 * 11/2021 Shanmugam ..... F25B 39/028
2022/0107121 A1 4/2022 Khaled et al.
2022/0357084 A1 * 11/2022 Elliott ..... F25B 1/10
2023/0077084 A1 * 3/2023 Shanmugam ..... F25B 49/02
2023/0213247 A1 * 7/2023 Legg ..... F25B 9/006 62/114
2023/0324085 A1 * 10/2023 Iyoshi ..... F25B 13/00 62/510
2023/0358449 A1 11/2023 Khaled et al.
2024/0011672 A1 * 1/2024 Christensen ..... F25B 49/02
2024/0011685 A1 * 1/2024 Sakthivel ..... F25B 41/20
2024/0027116 A1 * 1/2024 Takegami ..... F25B 49/02
2024/0053076 A1 * 2/2024 Cole ..... F25B 49/022
2024/0151437 A1 5/2024 Shanmugam et al.
2024/0191919 A1 * 6/2024 Mukherjee ..... F25B 9/008
2025/0146720 A1 * 5/2025 Sakthivel ..... F25B 9/008
2025/0251181 A1 * 8/2025 Iyoshi ..... F25B 7/00

* cited by examiner

$CO_2$ REFRIGERATION SYSTEM WITH SUPERHEAT CONTROL

TECHNICAL FIELD

This disclosure relates to cooling systems, particularly cooling systems that use carbon dioxide ($CO_2$) as a refrigerant.

BACKGROUND

Refrigeration systems are often used to provide cooling to temperature-controlled display devices (e.g., cases, merchandisers, etc.) in supermarkets, cold Storage, refrigerated warehouses, process facilities, and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically (1) compressed to a high temperature high pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

SUMMARY

The present disclosure relates to systems and methods for cooling.

In an example implementation, a transcritical refrigeration system includes a gas cooler/condenser; a receiver configured to collect refrigerant produced by the refrigeration system and including a first outlet through which the gas refrigerant exits the receiver and a second outlet through which liquid refrigerant exits the receiver; a gas bypass valve fluidly coupled to the outlet of the receiver and operable to control a pressure of the refrigerant in the receiver by controlling a flow of the gas refrigerant from the receiver through the gas bypass valve; and a medium temperature subsystem. The medium temperature subsystem includes one or more expansion valves; one or more medium temperature evaporators, at least one of the medium temperature evaporators including a medium temperature evaporator outlet; and a suction group including one or more transcritical compressors operable to compress gas refrigerant and discharge the compressed gas refrigerant into a discharge line. The system includes a superheat control system that includes a heat exchanger system including a first side configured to carry gas refrigerant passing between the gas cooler/condenser and an inlet of the receiver, and a second side in heat transfer communication with the first side; and a valve system including one or more valves. The valve system is configured to circulate gas refrigerant from the medium temperature evaporator outlet of at least one of the medium temperature evaporators such that at least a portion of the gas refrigerant passes through the second side of the heat exchanger and to the suction input of at least one of the one or more transcritical compressors of the suction group. The system includes a controller configured to perform operations including modulating at least one of the one or more valves of the valve system to control a flow of gas refrigerant from the evaporator outlet to the second side of the heat exchanger based on one or more characteristics of refrigerant in the refrigeration system.

In an aspect combinable with the example implementation, the operations include controlling a superheat of the refrigerant to at least one of the one or more transcritical compressors.

In another aspect combinable with one, some, or all of the previous aspects, the operations include controlling a flow of refrigerant through the second side of the heat exchanger to superheat at least a portion of the refrigerant circulating through the second side of the heat exchanger.

In another aspect combinable with one, some, or all of the previous aspects, the operations include controlling a flow of refrigerant through the second side of the heat exchanger based on one or more characteristics of refrigerant in the refrigeration system.

In another aspect combinable with one, some, or all of the previous aspects, the operations include determining whether one or more first operating parameters are within a first operating range; and in response to a determination that the one or more first operating parameters are within the first operating range, modulating at least one of the one or more valves of the valve system to control a flow of gas refrigerant from the evaporator outlet to the second side of the heat exchanger.

Another aspect combinable with one, some, or all of the previous aspects includes a junction between the evaporator outlet and an outlet of the gas bypass valve between the evaporator outlet and the first inlet of the heat exchanger.

In another aspect combinable with one, some, or all of the previous aspects, the heat exchanger is configured to receive a mixture of refrigerant from the outlet of the gas bypass valve and the at least one evaporator outlet.

In another aspect combinable with one, some, or all of the previous aspects, an outlet of the gas bypass valve is fluidly coupled to the suction input of at least one of the transcritical compressors.

In another aspect combinable with one, some, or all of the previous aspects, the valve system includes a three-way valve configured to control a flow of refrigerant through the second side of the heat exchanger.

In another aspect combinable with one, some, or all of the previous aspects, the three-way valve includes a first inlet, a second inlet, and a common outlet.

In another aspect combinable with one, some, or all of the previous aspects, the first inlet of the three-way valve is fluidly coupled to an input of the second side of the heat exchanger; the second inlet of the three-way valve is fluidly coupled to an output of the second side of the heat exchanger; and the common outlet of the three-way valve is fluidly coupled to the suction input of the one or more transcritical compressors.

Another aspect combinable with one, some, or all of the previous aspects includes a parallel compression system including one or more parallel compressors configured to receive gas refrigerant from the receiver.

Another aspect combinable with one, some, or all of the previous aspects includes a second heat exchanger including a first side configured to carry gas refrigerant passing between the gas cooler/condenser and an inlet of the receiver and a second side in heat transfer communication with the first side; and a second valve system including one or more valves and configured to circulate gas refrigerant from the receiver such that at least a portion of the gas refrigerant passes through the second side of the second heat exchanger and to the suction input of at least one of the one or more parallel compressors.

In another aspect combinable with one, some, or all of the previous aspects, the operations include modulating at least one of the one or more valves of the second valve system to control a flow of gas refrigerant from the receive to the second side of the second heat exchanger.

In another aspect combinable with one, some, or all of the previous aspects, at least one of the parallel compressors is convertible during operation to operate as an MT transcritical compressor.

In another aspect combinable with one, some, or all of the previous aspects, the refrigerant includes carbon dioxide.

Another aspect combinable with one, some, or all of the previous aspects includes a hot gas injection system configured to inject at least one of hot refrigerant gas from the discharge line into the suction input; or liquid refrigerant from the second outlet into the suction input.

Another aspect combinable with one, some, or all of the previous aspects includes a low-temperature cooling subsystem including one or more evaporators and one or more subcritical compressors.

In another aspect combinable with one, some, or all of the previous aspects, the receiver is configured to supply refrigerant to one or more of the one or more evaporators of the low-temperature subsystem.

Another aspect combinable with one, some, or all of the previous aspects includes an ejector system fluidly coupled between the gas cooler/condenser and the receiver.

Another aspect combinable with one, some, or all of the previous aspects includes a variable frequency drive coupled to at least one of the two or more transcritical compressors.

In another aspect combinable with one, some, or all of the previous aspects, the operations include operating the variable frequency drive to modulate a speed of the at least one transcritical compressor.

Another aspect combinable with one, some, or all of the previous aspects includes an oil management subsystem configured to provide oil to at least one of the one or more transcritical compressors.

In another example implementation, a transcritical refrigeration system includes a gas cooler/condenser; a receiver configured to collect refrigerant produced by the refrigeration system and including a receiver outlet through which the gas refrigerant exits the receiver; a high-pressure control valve configured to control a flow of refrigerant from the cooler/condenser to the receiver; a gas bypass valve fluidly coupled to the receiver outlet and operable to control a pressure of the refrigerant in the receiver by controlling a flow of the gas refrigerant from the receiver through the gas bypass valve; a cooling subsystem; a superheat control systems, a valve system; and a controller. The cooling subsystem includes one or more expansion valves; one or more evaporators, with at least one of the evaporators including an evaporator outlet; and a suction group including one or more transcritical compressors operable to compress gas refrigerant and discharge the compressed gas refrigerant into a discharge line. The superheat control system includes a heat exchanger system including a first side configured to carry gas refrigerant passing between the gas cooler/condenser and an inlet of the high-pressure control valve; and a second side in heat transfer communication with the first side and including a second side inlet and a second side outlet, the second side input in being in fluid communication with, and at substantially the same operating pressure as, the evaporator outlet of at least one the evaporators. The valve system includes one or more valves and is configured to route gas refrigerant from the evaporator outlet of the at least one evaporator such that at least a portion of the gas refrigerant from the evaporator outlet passes through the second side of the heat exchanger and to the suction input of at least one of the one or more transcritical compressors of the suction group. The controller is configured to perform operations including determining that one or more first operating parameters are within a first operating range; and in response to a determination that the one or more first operating parameters are within the first operating range, modulating at least one of the one or more valves of the valve system to control a flow of gas refrigerant from the evaporator outlet to the inlet of the second side.

In an aspect combinable with the example implementation, herein the operations include controlling a superheat of refrigerant to at least one of the one or more transcritical compressors.

In another aspect combinable with one, some, or all of the previous aspects, the cooling system includes a medium temperature subsystem.

In another aspect combinable with one, some, or all of the previous aspects, the refrigerant includes carbon dioxide.

In another example implementation, a method of operating a transcritical refrigeration system includes compressing a refrigerant in one in one or more transcritical compressors in a suction group of the transcritical refrigeration system; circulating the refrigerant from an outlet of at least one of the one or more transcritical compressors through a gas cooler/condenser; circulating the refrigerant from an outlet of gas cooler/condenser through a first side of a heat exchanger; collecting a portion of the refrigerant from an outlet of the first side of the heat exchanger into a receiver; controlling a pressure of the refrigerant in the receiver by controlling a flow of gas refrigerant from the receiver through the gas bypass valve; circulating liquid refrigerant from the receiver through one or more evaporators in a cooling subsystem of the refrigeration system; circulating the refrigerant from an evaporator outlet of at least one of the evaporators through a second side of the heat exchanger such that heat is transferred from the refrigerant in the first side of the heat exchanger to refrigerant in the second side of the heat exchanger; and circulating at least a portion of the refrigerant from the second side of the heat exchanger to a suction input of at least one of the one or more transcritical compressors.

In an aspect combinable with the example implementation, the cooling subsystem is a medium temperature subsystem.

Another aspect combinable with one, some, or all of the previous aspects includes controlling a flow of refrigerant through the second side of the heat exchanger to superheat at least a portion of the refrigerant circulating through the second side of the heat exchanger.

Another aspect combinable with one, some, or all of the previous aspects includes controlling a flow of refrigerant through the second side of the heat exchanger based on one or more characteristics of refrigerant in the refrigeration system.

In another aspect combinable with one, some, or all of the previous aspects, controlling the flow of refrigerant through the second side of the heat exchanger includes modulating a valve system to modulate a flow of refrigerant through the second side of the heat exchanger.

In another aspect combinable with one, some, or all of the previous aspects, controlling the flow of refrigerant through the second side of the heat exchanger includes modulating a three-way valve to modulate a flow of refrigerant through the second side of the heat exchanger.

In another aspect combinable with one, some, or all of the previous aspects, controlling a flow of refrigerant through the second side of the heat exchanger includes modulating a valve system to maintain a setpoint of one or more characteristics of refrigerant between the second side of the heat exchanger and the suction input.

Another aspect combinable with one, some, or all of the previous aspects includes measuring a temperature of refrigerant between an output of the second side of the heat exchanger and the suction input of the one or more transcritical compressors.

In another aspect combinable with one, some, or all of the previous aspects, the flow of refrigerant through the second side of the heat exchanger is controlled at least in part based on the measured temperature.

Another aspect combinable with one, some, or all of the previous aspects includes controlling a flow of refrigerant through the second side of the heat exchanger based at least in part on a measured temperature of refrigerant in the refrigeration system.

Another aspect combinable with one, some, or all of the previous aspects includes controlling a flow of refrigerant through the second side of the heat exchanger based at least in part on a measured pressure of refrigerant in the refrigeration system.

Another aspect combinable with one, some, or all of the previous aspects includes mixing refrigerant from an output of the gas bypass valve with the refrigerant from the evaporator output, and circulating at least a portion of the mixed refrigerant through the second side of the heat exchanger.

Another aspect combinable with one, some, or all of the previous aspects includes controlling the flow through the second side of the heat exchanger at least in part by modulating the gas bypass valve.

In another aspect combinable with one, some, or all of the previous aspects, the refrigerant includes carbon dioxide.

Another aspect combinable with one, some, or all of the previous aspects includes circulating at least a portion of the refrigerant from the at least one evaporator through an accumulator before the second side of the heat exchanger.

Another aspect combinable with one, some, or all of the previous aspects includes at least one of injecting hot refrigerant gas from the outlet of the at least one of the one or more transcritical compressors into a suction input of the one or more transcritical compressors; or injecting the liquid refrigerant from the receiver into the suction input of the one or more transcritical compressors.

Another aspect combinable with one, some, or all of the previous aspects includes adjusting a speed of one of the transcritical compressors to maintain a receiver pressure setpoint Particular implementations of the subject matter described in this specification can be implemented so as to realize one or more of the following advantages. Implementations of the present disclosure may make a refrigeration system more energy efficient. Implementations of the present disclosure may prevent liquid return from evaporators from entering compressors of a refrigeration system. Implementations of the present disclosure may allow the compressors of refrigeration system to operate within their operating envelope. Implementations of the present disclosure may reduce flash gas producing in a refrigeration system. Implementations of the present disclosure may allow a system to operate more efficiently with varying environmental conditions.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

In various implementations, a $CO_2$ refrigeration system includes control of MT suction superheat. The system can use heat from a flow of refrigerant from a gas cooler/condenser return. The system can include a medium temperature (MT) cooling sub-system. In some implementations, the system is an MT-only system (e.g., without a low temperature subcritical sub-system).

In some implementations, one side of a heat exchanger is connected to a gas cooler/condenser return line and a high pressure valve. The other side of the heat exchanger is connected to, by way of a three-valve, a mixture of MT return gas from a MT cases/evaporators and flash gas. A common outlet temperature from the three-way valve is controlled (e.g., by way of a controller such as described herein).

Examples of refrigeration systems with superheat control are described below. Referring generally to the Figures, a $CO_2$ refrigeration system is shown, according to various exemplary implementations. The $CO_2$ refrigeration system may be a vapor compression refrigeration system which uses primarily carbon dioxide (i.e., $CO_2$) as a refrigerant. In some implementations, a $CO_2$ booster system is used to provide cooling for temperature controlled display devices in a supermarket or other similar facility.

Figure 1:
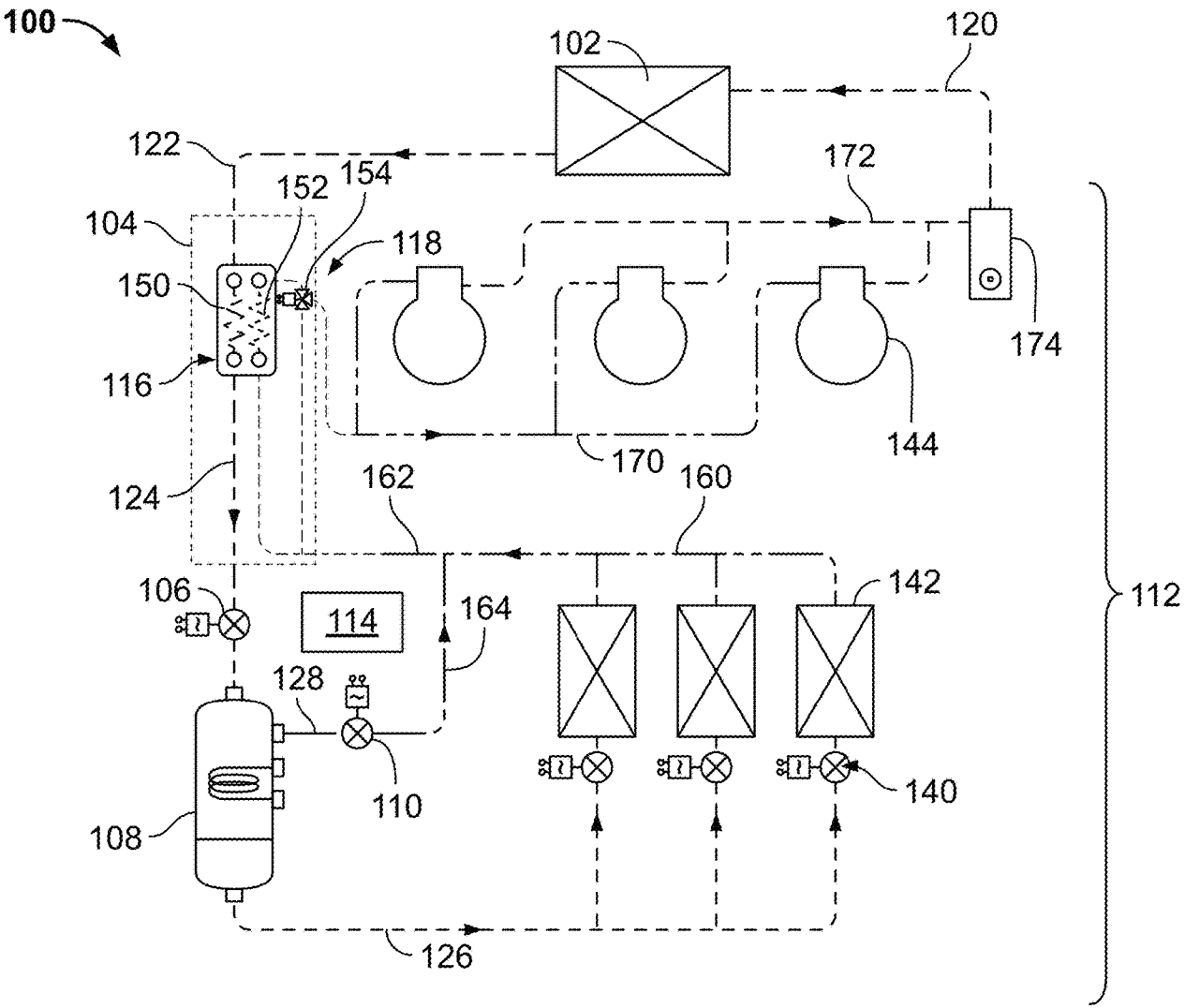
FIG. 1 is a block diagram of a $CO_2$ refrigeration system with superheat control according to an exemplary implementation.

FIG. 1 is a block diagram of a $CO_2$ refrigeration system according to an exemplary implementation. $CO_2$ refrigeration system 100 may be a vapor compression refrigeration system which uses primarily carbon dioxide ($CO_2$) as a refrigerant. However, it is contemplated that other refrigerants can, in some implementations, be substituted for $CO_2$ without departing from the teachings of the present disclosure.

$CO_2$ refrigeration system 100 and is shown to include a system of pipes, conduits, or other fluid channels for transporting the $CO_2$ refrigerant between various components of $CO_2$ refrigeration system 100. The thermodynamic components of $CO_2$ refrigeration system 100 include a gas cooler/condenser 102, a superheat control system 104, a high pressure valve 106, a receiver 108, a gas bypass valve 110, a medium-temperature ("MT") subsystem 112, and a controller 114. Superheat control system 104 includes heat exchanger 116 and valve system 118. Controller 114 is operable to control flow of refrigerant through valve system 118 and heat exchanger 116.

Gas cooler/condenser 102 may be a heat exchanger or other similar device for removing heat from the $CO_2$ refrigerant. Gas cooler/condenser 102 is shown receiving $CO_2$ gas from fluid conduit 130. In some implementations, the $CO_2$ gas in fluid conduit 120 may have a pressure within a range from approximately 45 bar to approximately 100 bar (i.e., about 650 psig to about 1450 psig), depending on ambient temperature and other operating conditions. In some implementations, gas cooler/condenser 102 may partially or fully condense $CO_2$ gas into liquid $CO_2$ (e.g., if system operation is in a subcritical region). The condensation process may result in fully saturated $CO_2$ liquid or a two-phase liquid-vapor mixture (e.g., having a thermodynamic vapor quality between 0 and 1). In other implementations, gas cooler/condenser 102 may cool the $CO_2$ gas (e.g., by removing superheat) without condensing the $CO_2$ gas into $CO_2$ liquid (e.g., if system operation is in a supercritical region). In some implementations, the cooling/condensation process is an isobaric process. Gas cooler/condenser 102 is shown outputting the cooled and/or condensed $CO_2$ refrigerant into fluid conduit 122.

In some implementations, $CO_2$ refrigeration system 100 includes a temperature sensor and a pressure sensor configured to measure the temperature and pressure of the $CO_2$ refrigerant exiting gas cooler/condenser 102. Sensors can be installed along fluid conduit 122, within gas cooler/condenser 102, or otherwise positioned to measure the temperature and pressure of the $CO_2$ refrigerant exiting gas cooler/condenser 102. In some implementations, $CO_2$ refrigeration system 100 includes a condenser fan that provides airflow across gas cooler/condenser 102. The speed of the condenser fan can be controlled to increase or decrease the airflow across gas cooler/condenser 102 to modulate the amount of cooling applied to the $CO_2$ refrigerant within gas cooler/condenser 102. In some implementations, $CO_2$ refrigeration system 100 also includes a temperature sensor and/or a pressure sensor configured to measure the temperature and/or pressure of the ambient air that flows across gas cooler/condenser 102 to provide cooling for the $CO_2$ refrigerant contained therein.

High pressure valve 106 receives the cooled and/or condensed $CO_2$ refrigerant from fluid conduit 122 and outputs the $CO_2$ refrigerant to fluid conduit 124. High pressure valve 106 may control the pressure of the $CO_2$ refrigerant in gas cooler/condenser 102 by controlling an amount of $CO_2$ refrigerant permitted to pass through high pressure valve 106. In some implementations, high pressure valve 106 is a high pressure thermal expansion valve (e.g., if the pressure in fluid conduit 122 is greater than the pressure in fluid conduit 124). In such implementations, high pressure valve 106 may allow the $CO_2$ refrigerant to expand to a lower pressure state. The expansion process may be an isenthalpic and/or adiabatic expansion process, resulting in a two-phase flash of the high pressure $CO_2$ refrigerant to a lower pressure, lower temperature state. The expansion process may produce a liquid/vapor mixture (e.g., having a thermodynamic vapor quality between 0 and 1). In some implementations, the $CO_2$ refrigerant expands to a pressure of approximately 38 bar (e.g., about 550 psig), which corresponds to a temperature of approximately 40° F. The $CO_2$ refrigerant then flows from fluid conduit 124 into receiver 108. In some implementations, high pressure valve 106 can be eliminated and an ejector can function as both high pressure valve and ejector.

Receiver 108 collects the $CO_2$ refrigerant from fluid conduit 124. In some implementations, receiver 108 may be a flash tank or other fluid reservoir. Receiver 108 includes a $CO_2$ liquid portion and a $CO_2$ vapor portion and may contain a partially saturated mixture of $CO_2$ liquid and $CO_2$ vapor. In some implementations, receiver 110 separates the $CO_2$ liquid from the $CO_2$ vapor. In one implementation, the receiver operating pressure of receiver 108 is about 60 to 90 bar. In another implementation, the receiver operating pressure of receiver 108 is about 45 to 60 bar, or 45 bar to 90 bar.

$CO_2$ liquid may exit receiver 108 and pass into conduit 126. Conduit 126 may be a liquid header leading to MT subsystem 112. The $CO_2$ vapor may exit receiver 108 through conduit 128. Conduit 128 is shown leading the $CO_2$ vapor to a gas bypass valve 110 (described in greater detail below).

In some implementations, $CO_2$ refrigeration system 100 includes temperature sensors and/or pressure sensors configured to measure the temperature and pressure within receiver 110. Sensors can be installed in or on receiver 110, or along any of the fluid conduits that contain $CO_2$ refrigerant at the same temperature and/or pressure as receiver 110, as the case may be.

MT subsystem 112 is shown to include one or more expansion valves 140, one or more MT evaporators 142, and one or more transcritical compressors 144. In various implementations, any number of expansion valves 140, MT evaporators 142, and transcritical compressors 144 may be present. Expansion valves 140 may be electronic expansion valves or other similar expansion valves. Expansion valves 140 are shown receiving liquid $CO_2$ refrigerant from fluid conduit 134 and outputting the $CO_2$ refrigerant to MT evaporators 142. Expansion valves 140 may cause the $CO_2$ refrigerant to undergo a rapid drop in pressure, thereby expanding the $CO_2$ refrigerant to a lower pressure, lower temperature two-phase state. In some implementations, expansion valves 140 may expand the $CO_2$ refrigerant to a pressure of approximately 20 bar to 25 bar. The expansion process may be an isenthalpic and/or adiabatic expansion process.

MT evaporators 142 are shown receiving the cooled and expanded $CO_2$ refrigerant from expansion valves 140. In some implementations, MT evaporators 142 may be associated with display cases/devices (e.g., if $CO_2$ refrigeration system 100 is implemented in a supermarket setting). MT evaporators 142 may be configured to facilitate the transfer of heat from the display cases/devices into the $CO_2$ refrigerant. The added heat may cause the $CO_2$ refrigerant to evaporate partially or completely. According to example implementations, the $CO_2$ refrigerant is fully evaporated in MT evaporators 142. In some implementations, the evaporation process may be an isobaric process. MT evaporators 142 output the $CO_2$ refrigerant via evaporator output line 160.

As noted above, superheat control system 104 includes heat exchanger 116 and valve system 118. Heat exchanger 116 includes a first side 150 and a second side 152. The second side 152 of heat exchanger 116 is in heat transfer communication with first side 150. Valve subsystem 118 includes three-way valve 154. Heat from refrigerant passing through first side 150 can transfer to refrigerant passing through second side 152.

Each side of heat exchanger 116 can include components that guide, channel, contain, or direct fluid through one or more passages from one or more inlets of the heat exchanger to one or more outlets of the heat exchanger. Examples of components of a heat exchanger include tubes, shells, pipes, coils, plates, or fins.

Refrigerant in evaporator output line 160 is combined at junction 162 with refrigerant passing through bypass output line 164. The mixture of refrigerant from evaporator output line 160 and bypass output line 164 is fed into the heat exchanger 116.

The inlet of first side 120 of heat exchanger 116 is fluidly coupled to the outlet of gas cooler/condenser 102 by way of conduit 122. The outlet of first side 120 of heat exchanger 116 is fluidly coupled to the inlet of high-pressure valve 106 by way of conduit 124.

The inlet of the second side 152 of heat exchanger 116 is fluidly coupled to junction 162, which conveys a mixture of refrigerant from evaporator output line 160 and bypass output line 164. The input of the second side 152 of heat exchanger can be at substantially the same operating pressure as the evaporator output line 160. The outlet of second side 152 of heat exchanger 116 is fluidly coupled to three-way valve 154. Three-way valve 154 can be modulated to control flow of refrigerant from evaporator output line 160 and bypass output line 164 through second side 152 of heat exchanger 116. All or a portion of the refrigerant from evaporator output line 160 can pass through second side 152 of heat exchanger 116.

In the example shown in FIG. 1, one inlet of three-way valve 154 is fluidly coupled to the inlet of the second side 152 of heat exchanger 116. The other inlet of three-way valve 154 is fluidly coupled to the outlet of the second side 152 of heat exchanger 116. The common output of three-way valve 154 is coupled to suction input line 170. Suction input line 170 feeds transcritical compressors 144. By modulating three-way valve 154, the portion of refrigerant from the evaporator output (and, in this example, from the gas bypass line) that passes through second side 154 of the superheat control system 104 before reaching suction input line 170 for transcritical compressors 144 can be controlled.

In the example shown in FIG. 1, valve system 118 of the superheat control system 104 includes a three-way valve. In other implementations, a valve system for a superheat system includes other types or combinations of valves. For example, a valve system of a superheat control system can include a two-way valve coupled to each of the inlet and outlet of the second side 152 of heat exchanger 116.

Transcritical compressors 144 combine to form a compressor suction group for MT subsystem 112. Transcritical compressors 144 compress the $CO_2$ refrigerant into a superheated gas having a pressure within a range of approximately 45 bar to approximately 100 bar. The output pressure from transcritical compressors 144 may vary depending on ambient temperature and other operating conditions. In the example shown in FIG. 1, transcritical compressors 144 operate in a transcritical mode. In operation, the $CO_2$ discharge gas exits suction group transcritical compressors 144 and flows through conduit 172, oil separator 174, through line 120, and into gas cooler/condenser 102.

In various implementations, a refrigeration system includes only a medium temperature subsystem (for example, as shown in FIG. 1). In some implementations, however, a refrigeration system includes a low temperature (LT) subsystem in addition to, or instead of, an MT subsystem. The LT subsystem can include one or more expansion valves, one or more LT evaporators, and one or more subcritical compressors. In other implementations, a $CO_2$ refrigeration system can operate with an AC module interfacing with only an MT subsystem.

$CO_2$ refrigeration system 100 includes gas bypass valve 110. Gas bypass valve 110 may receive the $CO_2$ vapor from fluid conduit 128 and output the $CO_2$ refrigerant to MT subsystem 118. In some implementations, gas bypass valve 110 is arranged in series with transcritical compressors 144. In other words, $CO_2$ vapor from receiver 110 may pass through both gas bypass valve 112 and transcritical compressors 144. Transcritical compressors 154 may compress the $CO_2$ vapor passing through gas bypass valve 112 from a low pressure state (e.g., approximately 30 bar or lower) to a high pressure state (e.g., approximately 45-100 bar).

Gas bypass valve 110 can be operated to control a flow of gas refrigerant from receiver 110 into bypass output line 164. Gas bypass valve 110 may be operated to regulate or control the pressure within receiver 110 (e.g., by adjusting an amount of $CO_2$ refrigerant permitted to pass through gas bypass valve 110). For example, gas bypass valve 110 may be adjusted (e.g., variably opened or closed) to adjust the mass flow rate, volume flow rate, or other flow rates of the $CO_2$ refrigerant through gas bypass valve 110. Gas bypass valve 110 may be opened and closed (e.g., manually, automatically, by a controller, etc.) as needed to regulate the pressure within receiver 108.

In some implementations, gas bypass valve 110 includes a sensor for measuring a flow rate (e.g., mass flow, volume flow, etc.) of the $CO_2$ refrigerant through gas bypass valve 110. In other implementations, gas bypass valve 110 includes an indicator (e.g., a gauge, a dial, etc.) from which the position of gas bypass valve 110 may be determined. This position may be used to determine the flow rate of $CO_2$ refrigerant through gas bypass valve 110, as such quantities (e.g., mass flow or volumetric flow or flow rate) may be proportional or otherwise related.

In some implementations, gas bypass valve 110 is a thermal expansion valve. According to one implementation, the pressure within receiver 108 is regulated by gas bypass valve 110 to a pressure of approximately 38 bar.

In some implementations, controller 114 is operated to control superheat control system 104 using refrigerant received from evaporator output line 160 of MT sub-system 112. controller 114 is operated to control superheat control system 104 can be operated to maintain operation of compressors 144 within the compressors' operating envelope.

In the example shown in FIG. 1, three-way valve 154 can be modulated (e.g., by controller 114) to control the portion of refrigerant from evaporator output line 160 that passes through second side 152. Refrigerant that passes through second side 152 of heat exchanger 116 can receive heat from refrigerant from gas cooler/condenser 102 that passes through first side 150 of heat exchanger 116. Controller 114 can control the flow of refrigerant from the evaporator output based on sensor information. In some implementations, superheat control system 104 controls the flow of refrigerant through second side 152 based on measured temperature at the common outlet of three-way valve 154.

Figure 2:
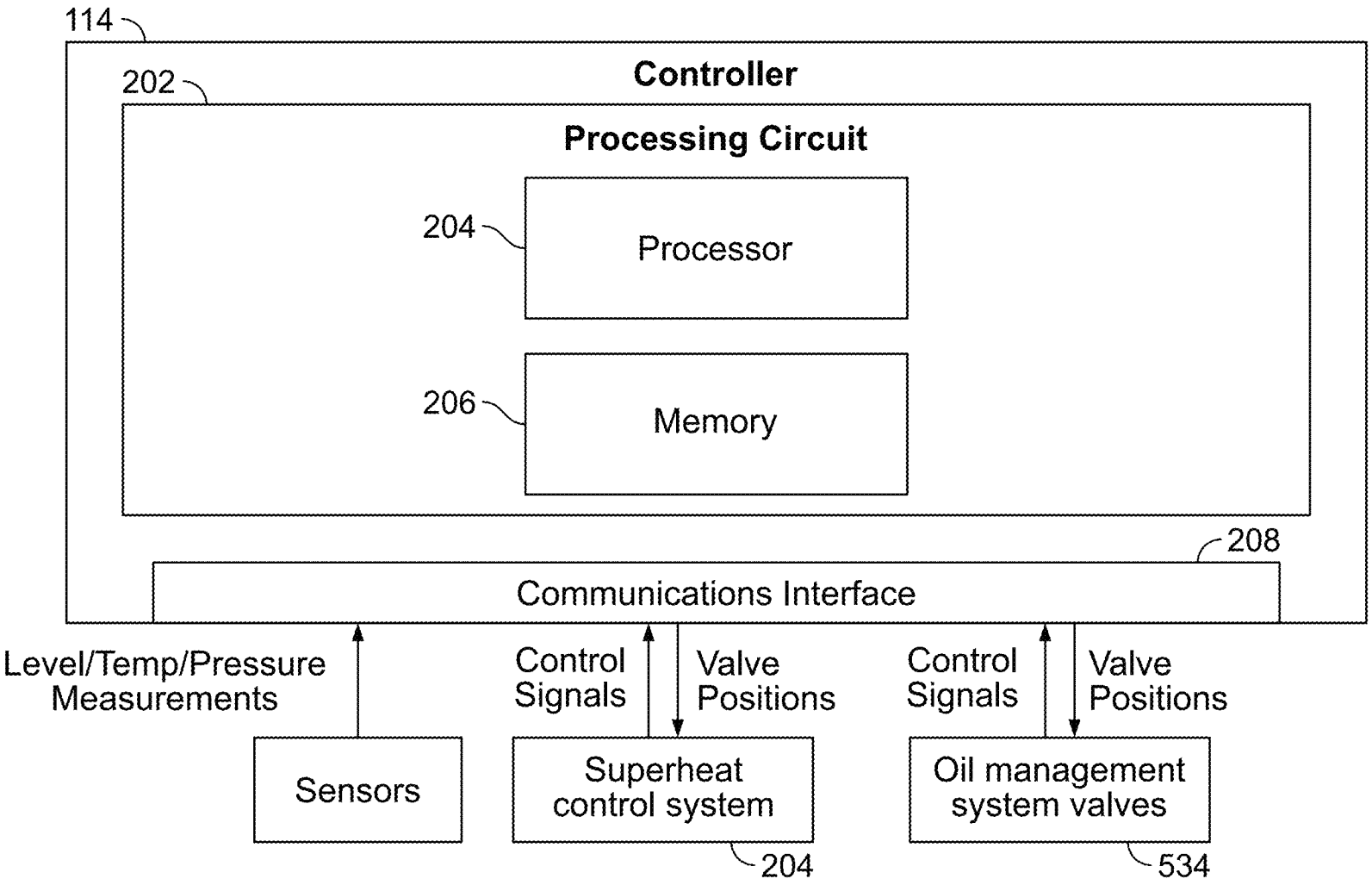
FIG. 2 is a block diagram illustrating a controller according to some implementations.

FIG. 2 is a block diagram illustrating controller 114 in greater detail according to an exemplary implementation. Controller 114 may receive signals from one or more measurement devices (e.g., pressure sensors, temperature sensors, flow sensors, etc.) located within $CO_2$ refrigeration system 100. Controller 114 may use the input signals to determine appropriate control actions for controllable devices of $CO_2$ refrigeration system 100 (e.g., compressors, valves, flow diverters, power supplies, etc.). For example, controller 114 is shown providing control signals to gas bypass valve 110 and three-way valve 154 of superheat control system 104.

In some implementations, controller 114 is configured to operate gas bypass valve 110, one or more superheat control system valves, and one or more parallel compressor activation valves. For example, controller 114 can operate three-way valve 154 to control a flow of refrigerant from the evaporator output through heat exchanger 116 based on information from measurement devices.

Figure 7:
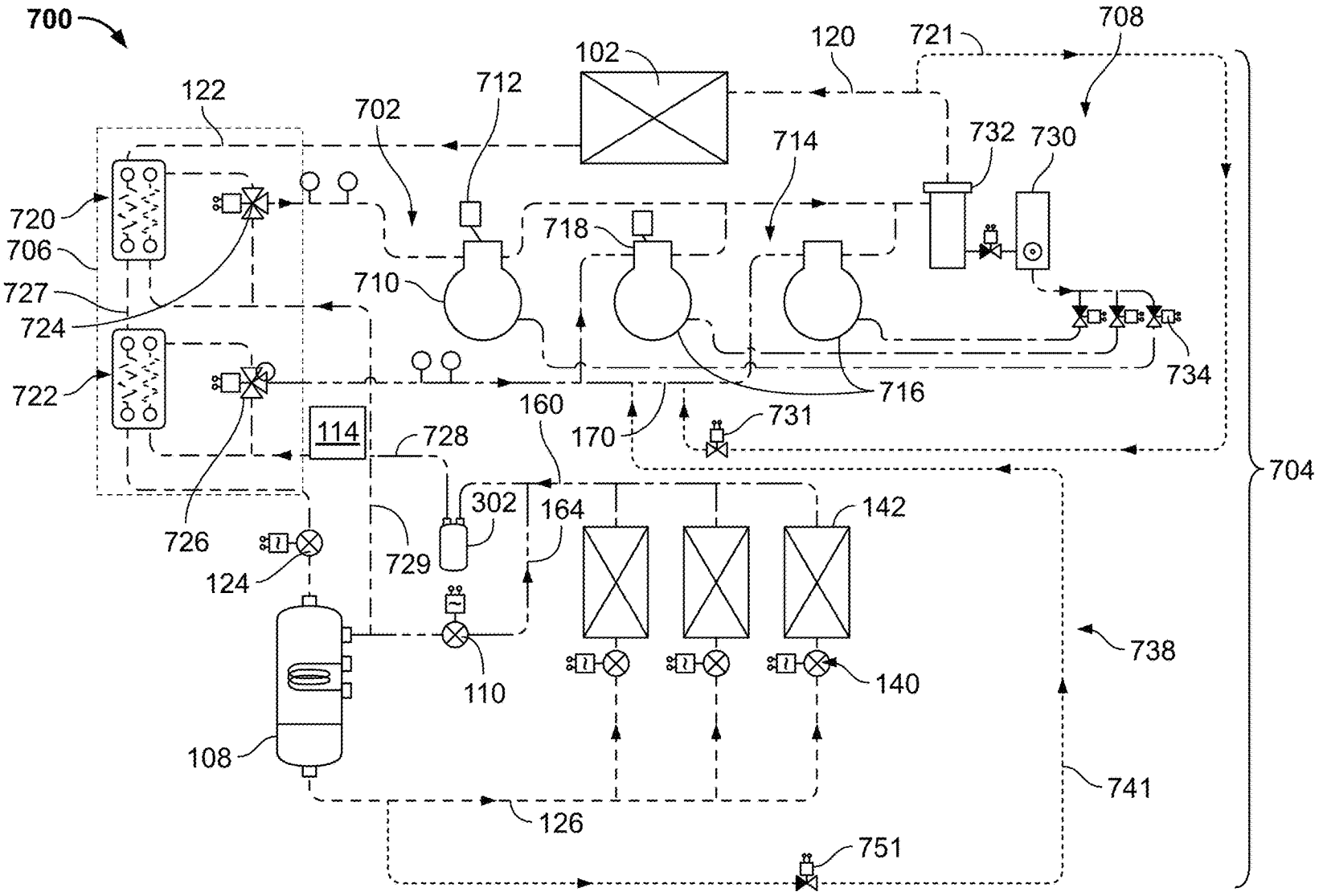
FIG. 7 illustrates a refrigeration system having a superheat control system with a parallel compressor and superheat control system, as well as a hot gas bypass system, according to some implementations.

Measurement devices can include pressure and temperature sensors, such as shown in suction input line 120 of FIG. 7 and applicable in all example embodiments of the present disclosure. These measurement devices (labeled "T" for a temperature sensors and "P" for a pressure sensor) can be used to measure temperature and pressure of a flow of refrigerant, e.g., in the suction input line 120. Such measurements can be provided or otherwise identified by the controller 114 and used by the controller 114 to calculate superheat. Based on the calculated superheat, the controller 114 can operate three-way valve 154 (or other valves as described in the present disclosure) to maintain a constant or substantially constant superheat.

Controller 114 may include feedback control functionality for adaptively operating the various components of $CO_2$ refrigeration system 100. For example, controller 114 may receive a setpoint (e.g., a level setpoint, a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 114 based on a history of data measurements. In some implementations, controller 114 receives a setpoint for a liquid level of one or more of the receivers in $CO_2$ refrigeration system 100.

Controller 114 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some implementations, controller 114 is a local controller for $CO_2$ refrigeration system 100. In other implementations, controller 114 is a supervisory controller for a plurality of controlled subsystems (e.g., a refrigeration system, an AC system, a lighting system, a security system, etc.). For example, controller 114 may be a controller for a comprehensive building management system incorporating $CO_2$ refrigeration system 100. Controller 114 may be implemented locally, remotely, or as part of a cloud-hosted suite of building management applications.

Controller 114 includes a communications a processing circuit 202. Processing circuit 202 is shown to include a processor 204 and memory 206. Processor 204 can be implemented as a general purpose processor, an application specific integrated circuit (ASIC), one or more field programmable gate arrays (FPGAs), a group of processing components, a microcontroller, or other suitable electronic processing components. Memory 206 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 206 may be or include volatile memory or non-volatile memory. Memory 206 may include database components, object code components, script components, or any other type of information structure for supporting the various activities and information structures described in the present application. According to an exemplary implementation, memory 206 is communicably connected to processor 204 via processing circuit 202 and includes computer code for executing (e.g., by processing circuit 202 and/or processor 204) one or more processes or control features described herein.

Controller 114 includes a communications interface 208. Communications interface 208 can be or include wired or wireless interfaces (e.g., jacks, antennas, transmitters, receivers, transceivers, wire terminals, etc.) for conducting electronic data communications. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 208 can include an Ethernet card and port for sending and receiving data via an Ethernet-based communications link or network. In another example, communications interface 208 can include a Wi-Fi transceiver or a cellular or mobile phone transceiver for communicating via a wireless communications network.

Figure 3:
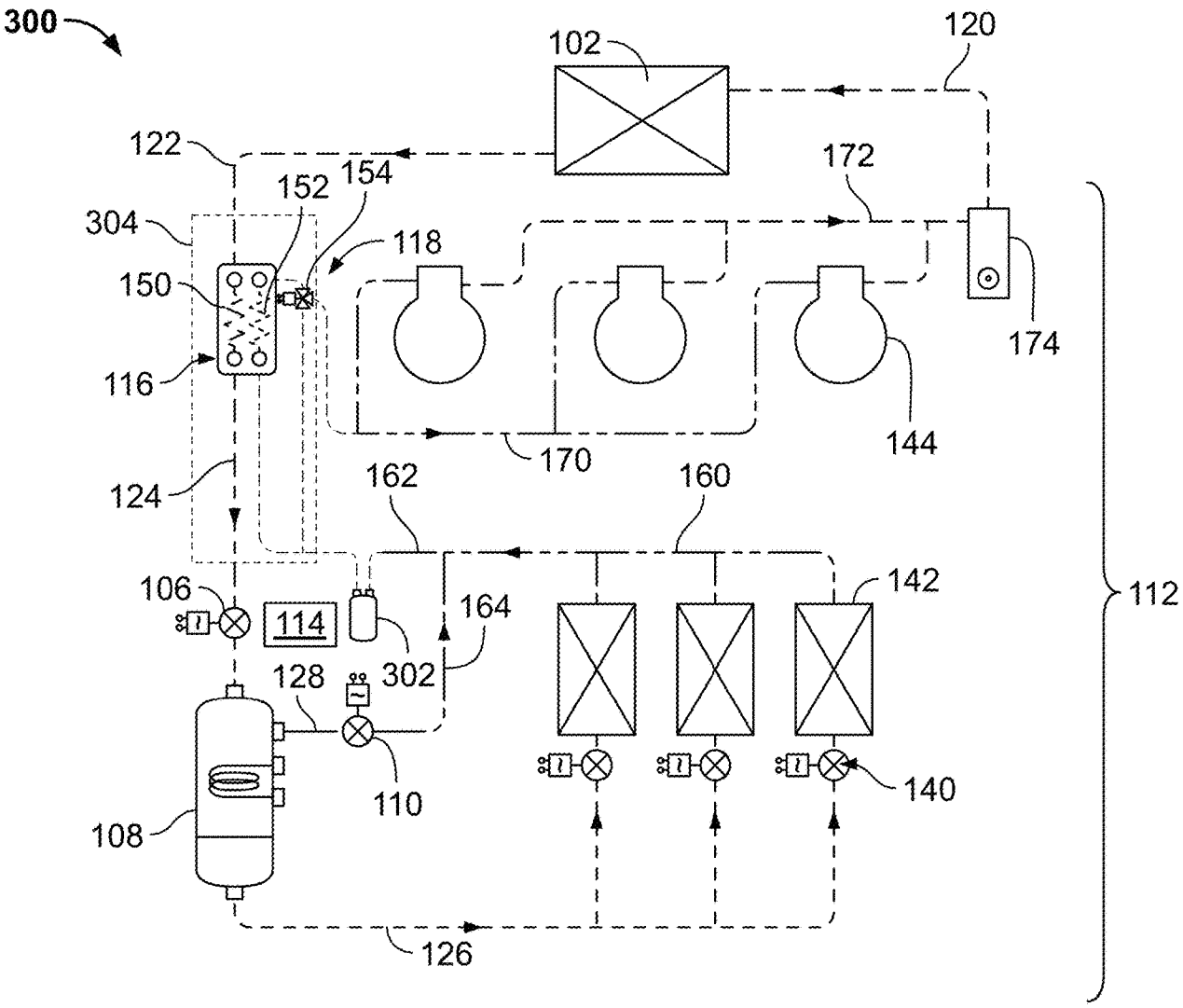
FIG. 3 illustrates a refrigeration system including a superheat control system and an accumulator according to some implementations.

FIG. 3 illustrates a refrigeration system including a superheat control system and an accumulator according to some implementations. $CO_2$ refrigeration system 300 includes gas cooler/condenser 102, accumulator 302, superheat control system 304, high pressure valve 106, receiver 108, gas bypass valve 110, MT sub-system 112, and controller 114. Superheat control system 304 can be operated to circulate refrigerant from the MT evaporators through heat exchanger 116. Superheat control system 304 can modulate a flow of refrigerant from the MT evaporators through heat exchanger 116 to control MT suction superheat. Accumulator 302 may prevent liquid and oil floodback from the evaporators.

Figure 4:
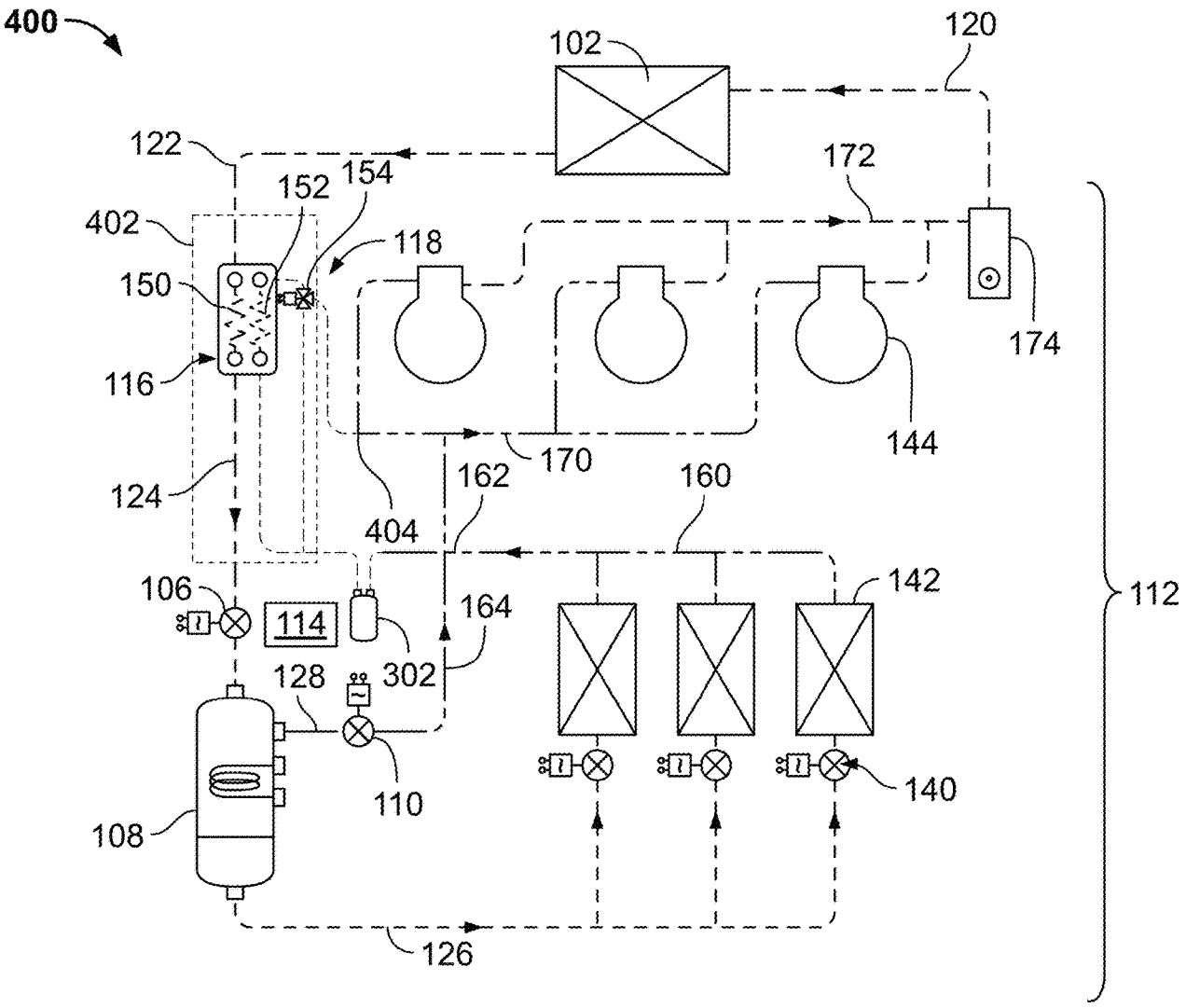
FIG. 4 illustrates a refrigeration system including a superheat control system with heating of refrigerant from a MT evaporator output before the refrigerant is mixed with flash gas according to some implementations.

In some implementations, bypass gas from a receiver is mixed with refrigerant from an evaporator output after the refrigerant from the has passed through a superheat control system. FIG. 4 illustrates a refrigeration system including a superheat control system with heating of refrigerant from a MT evaporator output before the refrigerant is mixed with flash gas according to some implementations. $CO_2$ refrigeration system 400 includes gas cooler/condenser 102, accumulator 302, superheat control system 404, high pressure valve 106, receiver 108, gas bypass valve 110, MT sub-system 112, and controller 114.

Figure 5:
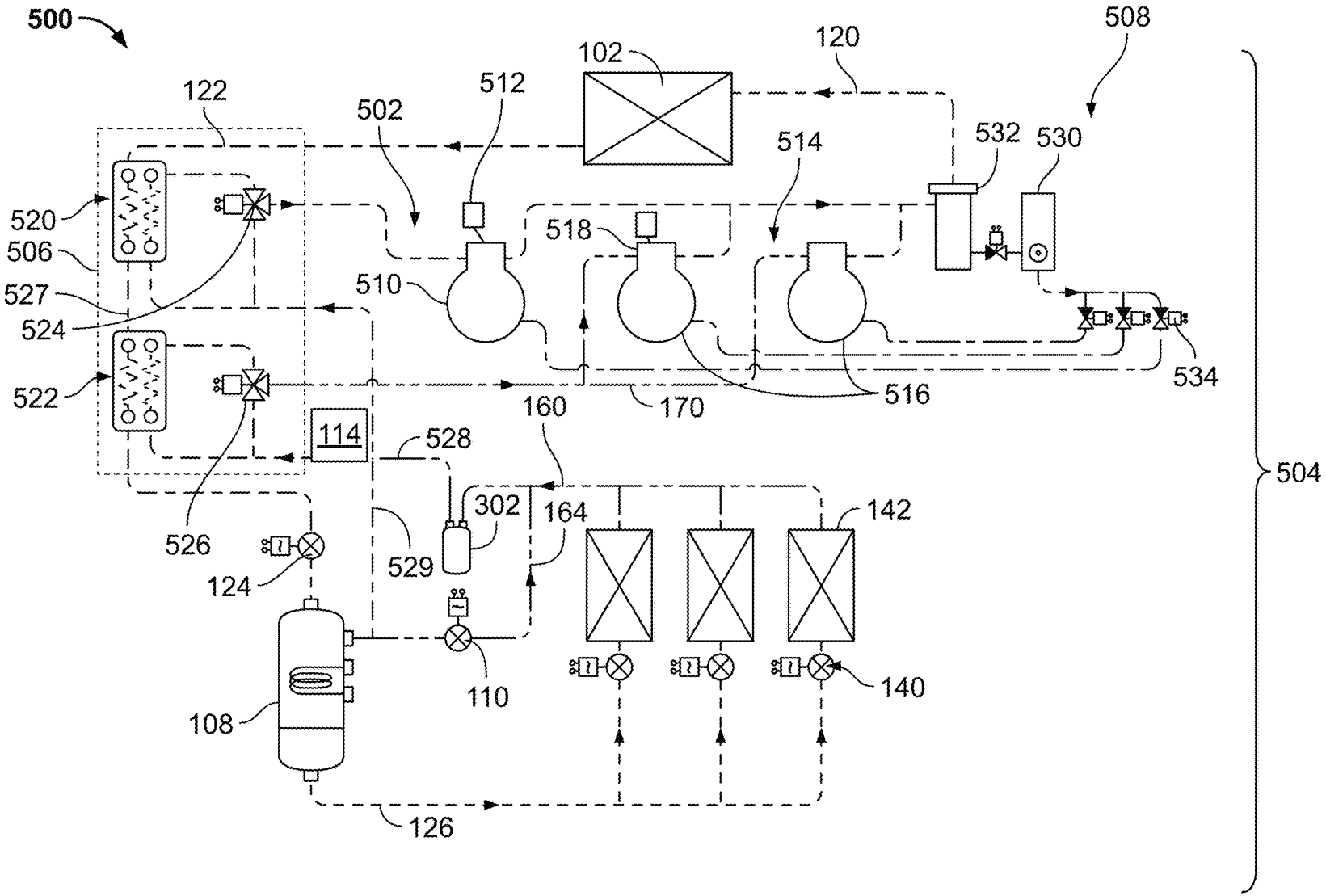
FIG. 5 illustrates a refrigeration system having a superheat control system with a parallel compressor and superheat control system according to some implementations.

In some implementations, a refrigeration system includes separate heat exchangers for refrigerant from evaporators and flash gas. FIG. 5 illustrates a refrigeration system having a superheat control system with a parallel compressor and superheat control system according to some implementations. $CO_2$ refrigeration system 500 includes gas cooler/condenser 102, parallel compression system 502, MT cooling sub-system 504, superheat control system 506, high pressure valve 106, receiver 108, gas bypass valve 110, accumulator 302, controller 114, and oil management system 508.

Parallel compression system 502 includes parallel compressor 510 and variable frequency drive 512. Variable frequency drive 512 is coupled to parallel compressor 510. MT compressor suction group 514 includes MT transcritical compressors 516 and variable frequency drive 518. Variable frequency drive 512 is coupled to the first one of MT transcritical compressors 516.

Superheat control system 506 includes heat exchanger 520, heat exchanger 522, three-way valve 524, and three-way valve 526. Three-way valve 524 and three-way valve 526 are operably coupled to controller 114. Each of heat exchanger 520 and heat exchanger 522 includes a first side and a second side in heat transfer communication with one another.

The inlet of the first side of heat exchanger 520 is fluidly coupled to the outlet of gas cooler/condenser 102 by way of conduit 122. The outlet of first side 120 of heat exchanger 520 is fluidly coupled to the inlet of the first side of heat exchanger 522 by way of conduit 527.

The inlet of the second side of heat exchanger 520 is receiver gas output line 529, which conveys refrigerant gas from receiver 110. The outlet of the second side of heat exchanger 520 is fluidly coupled to three-way valve 524. Three-way valve 524 can be modulated to control flow of refrigerant from receiver gas output line 529 through the second side of heat exchanger 520. All or a portion of the refrigerant from refrigerant from receiver gas output line 529 can pass through the second side of heat exchanger 520.

The inlet of the first side of heat exchanger 522 is fluidly coupled to the outlet of the first side heat exchanger 520 by way of conduit 527. The outlet of first side of heat exchanger 522 is fluidly coupled to the inlet of high-pressure valve 106 by way of conduit 124.

The inlet of the second side of heat exchanger 522 is fluidly coupled to evaporator output line 528. The outlet of the second side of heat exchanger 522 is fluidly coupled to three-way valve 526. Three-way valve 526 can be modulated to control flow of refrigerant from evaporator output line 528 through the second side of heat exchanger 522. All or a portion of the refrigerant from evaporator output line 528 can pass through the second side of heat exchanger 526.

By modulating three-way valve 524, the portion of gas from receiver 110 that passes through the second side of the heat exchanger 520 before reaching the suction input line of parallel compressor 510 can be controlled. By modulating three-way valve 526, the portion of refrigerant from the MT evaporator output that passes through the second side of the heat exchanger 522 before reaching the suction input line of MT transcritical compressors 514 can be controlled. Accordingly, in the example shown in FIG. 5, superheat from the gas cooler output to the suction line of the parallel compressor(s) 510 and to the suction line of MT transcritical compressors 514 can be separately controlled.

Parallel compressor 510 receives refrigerant from receiver gas output line 529 after the refrigerant passes through superheat control system 506.

Compressor mass flow rate/capacity can be controlled by compressor speed (e.g., 25 Hz to 75 Hz) or by using unloaders. In the example shown in FIG. 5, $CO_2$ refrigeration system 100 includes variable frequency drives 512 and 518. Variable frequency drives 512 and 518 are operably coupled to controller 114. Variable frequency drive 512 can be operated to control a speed of parallel compressor 510. Variable frequency drive 518 can be operated to control a speed of the first one of MT transcritical compressors 516.

In certain implementations, compressor mass flow rate/capacity is controlled using a digital unloader. The digital unloader can include a solenoid valve that is energized to unload the compressor and de-energized to load the compressor.

Oil management system 508 includes oil separator 530 and oil reservoir 532. Valves 534 can be operated to control the provision of oil to MT transcritical compressors 516 by way of an oil manifold.

Figure 6:
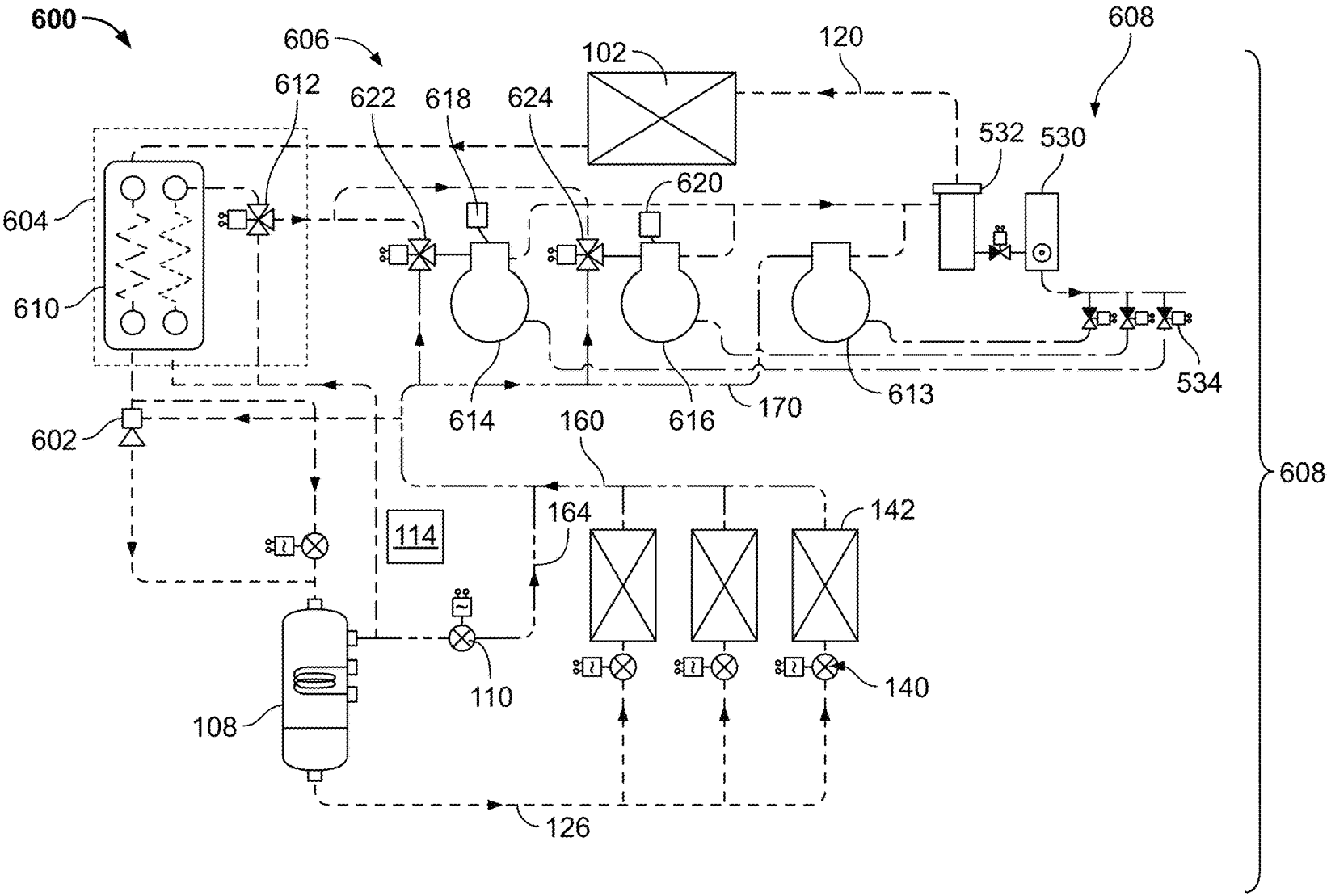
FIG. 6 illustrates an MT-only transcritical system with a convertible compressor, an ejector, a superheat control system, and an oil management system according to some implementations.

In some implementations, a parallel/interstage compressor of a refrigeration system processes a mixture of flash gas generated by a gas cooler/condenser and return gas from the evaporators of an MT sub-system. In certain implementations, a cooling system includes one or more compressors that are convertible from operation as compressors within a suction group of a medium temperature subsystem to operation as a parallel compressors (e.g., interstage compressors), and vice versa. Conversion can be achieved using a modulating three-way valve that switches an input from each convertible compressor to receive refrigerant from the output of a receiver/flash tank instead of refrigerant from the output of the evaporators of the medium temperature system. FIG. 6 illustrates an MT-only transcritical system with a convertible compressor, an ejector, a superheat control system, and an oil management system according to some implementations. $CO_2$ refrigeration system 600 includes ejector 602, superheat control system 604, parallel compressor system 606, and MT sub-system 608. Superheat control system 604 includes heat exchanger 610 and heat exchanger bypass valve 612. MT sub-system 608 includes MT compressor(s) 613.

Parallel compression system 606 includes interstage (IT)/MT convertible transcritical compressors 614 and 616, variable frequency drives 618 and 620, and parallel compressor activation valves 622 and 624. In this example, each of parallel compressor activation valve 622, parallel compressor activation valve 624, and heat exchanger bypass valve 612 is a 3-way valve.

Parallel compressor activation valve 622 is installed such that fluid communication to a suction input line to IT/MT convertible transcritical compressor 614 can be modulated to switch between a flow refrigerant between the MT evaporator outlet and flash gas from receiver 110.

Parallel compressor activation valve 624 is installed such that fluid communication to a suction input line to IT/MT convertible transcritical compressor 616 can be modulated to switch between a flow refrigerant between the MT evaporator outlet and flash gas from receiver 110.

Compressor mass flow rate/capacity can be controlled by compressor speed (e.g., 25 Hz to 75 Hz) or by using unloaders. Variable frequency drive 618 and variable frequency drive 620 are operably coupled to controller 114. Variable frequency drive 618 can be operated to control a speed of IT/MT convertible transcritical compressor 614. Variable frequency drive 190*b* can be operated to control a speed of IT/MT convertible transcritical compressor 616.

High pressure valve 106 and ejector 602 are installed in parallel. Refrigerant from gas cooler/condenser 102 passes through the first side of heat exchanger 610 and then to high pressure valve 106, ejector 602, or both. Heat exchanger bypass valve 612 can be operated such that refrigerant from receiver 110 passes through the second side of heat exchanger 610 and then to the suction side of IT/MT convertible transcritical compressors 614 and 616.

Heat exchanger bypass valve 612 can be modulated so that gas refrigerant from receiver 110 bypasses the second side of heat exchanger 610 and passes, for example, directly from receiver 110 to a suction inlet of IT/MT convertible transcritical compressors 614 and 616.

In this example, ejector 602 is a high-pressure ejector. Other types of ejectors can be used. Examples of ejectors in various implementations include gas (high pressure or low pressure), liquid, or combination ejectors. Additional components such as an accumulator, check valve, or additional sensors can be included in some implementations.

FIG. 7 illustrates a refrigeration system 700 having a superheat control system with a parallel compressor and superheat control system, as well as a hot gas bypass system, according to some implementations. $CO_2$ refrigeration system 700 includes gas cooler/condenser 102, parallel compression system 702, MT cooling sub-system 704, superheat control system 706, high pressure valve 106, receiver 108, gas bypass valve 110, accumulator 302, controller 114, hot gas injection system 738, and oil management system 708.

Parallel compression system 702 includes parallel compressor 710 and variable frequency drive 712. Variable frequency drive 712 is coupled to parallel compressor 710. MT compressor suction group 714 includes MT transcritical compressors 716 and variable frequency drive 718. Variable frequency drive 712 is coupled to the first one of MT transcritical compressors 716.

Superheat control system 706 includes heat exchanger 720, heat exchanger 722, three-way valve 724, and three-way valve 726. Three-way valve 724 and three-way valve 726 are operably coupled to controller 114. Each of heat exchanger 720 and heat exchanger 722 includes a first side and a second side in heat transfer communication with one another.

The inlet of the first side of heat exchanger 720 is fluidly coupled to the outlet of gas cooler/condenser 102 by way of conduit 122. The outlet of first side 120 of heat exchanger 720 is fluidly coupled to the inlet of the first side of heat exchanger 722 by way of conduit 727.

The inlet of the second side of heat exchanger 720 is receiver gas output line 729, which conveys refrigerant gas from receiver 110. The outlet of the second side of heat exchanger 720 is fluidly coupled to three-way valve 724. Three-way valve 724 can be modulated to control flow of refrigerant from receiver gas output line 729 through the second side of heat exchanger 720. All or a portion of the refrigerant from refrigerant from receiver gas output line 729 can pass through the second side of heat exchanger 720.

The inlet of the first side of heat exchanger 722 is fluidly coupled to the outlet of the first side heat exchanger 720 by way of conduit 727. The outlet of first side of heat exchanger 722 is fluidly coupled to the inlet of high-pressure valve 106 by way of conduit 124.

The inlet of the second side of heat exchanger 722 is fluidly coupled to evaporator output line 728. The outlet of the second side of heat exchanger 722 is fluidly coupled to three-way valve 726. Three-way valve 726 can be modulated to control flow of refrigerant from evaporator output line 728 through the second side of heat exchanger 722. All or a portion of the refrigerant from evaporator output line 728 can pass through the second side of heat exchanger 726.

By modulating three-way valve 724, the portion of gas from receiver 110 that passes through the second side of the heat exchanger 720 before reaching the suction input line of parallel compressor 710 can be controlled. By modulating three-way valve 726, the portion of refrigerant from the MT evaporator output that passes through the second side of the heat exchanger 722 before reaching the suction input line of MT transcritical compressors 714 can be controlled. Accordingly, in the example shown in FIG. 5, superheat from the gas cooler output to the suction line of the parallel compressor(s) 710 and to the suction line of MT transcritical compressors 714 can be separately controlled.

Parallel compressor 710 receives refrigerant from receiver gas output line 729 after the refrigerant passes through superheat control system 706.

Compressor mass flow rate/capacity can be controlled by compressor speed (e.g., 25 Hz to 75 Hz) or by using unloaders. In the example shown in FIG. 7, $CO_2$ refrigeration system 100 includes variable frequency drives 712 and 718. Variable frequency drives 712 and 718 are operably coupled to controller 114. Variable frequency drive 712 can be operated to control a speed of parallel compressor 710. Variable frequency drive 718 can be operated to control a speed of the first one of MT transcritical compressors 716.

In certain implementations, compressor mass flow rate/capacity is controlled using a digital unloader. The digital unloader can include a solenoid valve that is energized to unload the compressor and de-energized to load the compressor.

Oil management system 708 includes oil separator 730 and oil reservoir 732. Valves 734 can be operated to control the provision of oil to MT transcritical compressors 716 by way of an oil manifold.

The hot gas bypass injection 738, in this example, includes a hot gas conduit 721 that is fluidly coupled between the fluid conduit 120 (that goes to the inlet of the condenser/gas cooler 102) and the suction input line 170 to the MT compressors 716, which includes hot gas bypass valve 731. The hot gas injection system 738 further includes liquid injection conduit 741 coupled between the conduit 126 (downstream of receiver 108) and the suction input line 170 to the MT compressors 716, which includes liquid injection valve 751. Injection of hot gas refrigerant from hot gas conduit 721 and/or liquid refrigerant from liquid injection conduit 741 can be performed, e.g., based on a superheat setpoint. If the superheat is less than a set point (e.g., less than 18° F.), then hot gas can be injected from the conduit 120, through the hot gas bypass conduit 721, into MT suction line input 170 by operating the hot gas bypass valve 731. If the superheat is greater than the set point (e.g., greater than 50° F.), then liquid injection can be introduced into the MT suction line input 120 through the liquid injection conduit 741 by operating the liquid injection valve 751. Hot gas injection and liquid injection can be activated if the superheat is out of set point range even after regulating one or both of the three-way control valves 724 or 726.

In some implementations, a dual heat exchanger superheat control system (such as described above with respect to FIG. 5) can include convertible compressors. For example, a three-way valve in the arrangement shown for parallel compressor activation valve 622 (shown in FIG. 6) can be included downstream of three-way valve 524 shown in FIG. 5.

Applications of systems and processes described in the present disclosure include a commercial supermarket, a cold storage warehouse, and a process cooling facility. In one implementation, a commercial supermarket has two sets of evaporators, for example, 60 bar and 45 bar medium temp evaporators. In some implementations, a cold storage warehouse or process cooling facility includes refrigeration and air conditioning.

In various examples described above, a $CO_2$ refrigeration system is cooled by an adiabatic gas cooler. In other implementations, a $CO_2$ refrigeration system can be cooled by other systems, such as an air cooled or water cooled device.

The present disclosure contemplates methods, systems and program products on memory or other machine-readable media for accomplishing various operations. Systems and processes described in the present disclosure may be implemented using existing computer processors, or by a special purpose computer processor for an appropriate system, incorporated for this or another purpose, or by a hardwired system. Implementations within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Particular implementations of the subject matter have been described. Other embodiments, alterations, and permutations of the described embodiments are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A transcritical refrigeration system, comprising:

a gas cooler/condenser;

a receiver configured to collect refrigerant produced by the refrigeration system and comprising a first outlet through which the gas refrigerant exits the receiver and a second outlet through which liquid refrigerant exits the receiver;

a gas bypass valve fluidly coupled to the first outlet of the receiver and operable to control a pressure of the refrigerant in the receiver by controlling a flow of the gas refrigerant from the receiver through the gas bypass valve;

a medium temperature subsystem, comprising:

one or more expansion valves;

one or more medium temperature evaporators, at least one of the medium temperature evaporators comprising a medium temperature evaporator outlet; and a suction group comprising one or more transcritical compressors operable to compress gas refrigerant and discharge the compressed gas refrigerant into a discharge line; and a superheat control system, comprising:

at least one heat exchanger comprising a first side configured to carry gas refrigerant passing between the gas cooler/condenser and an inlet of the receiver, and a second side in heat transfer communication with the first side; and a valve system comprising one or more valves, the valve system configured to circulate gas refrigerant from the medium temperature evaporator outlet of at least one of the medium temperature evaporators such that at least a portion of the gas refrigerant passes through the second side of the heat exchanger and to a suction input of at least one of the one or more transcritical compressors of the suction group, the one or more valves comprising a three-way valve configured to control a flow of refrigerant through the second side of the heat exchanger, the three-way valve comprising:

a first inlet fluidly coupled to an input of the second side of the heat exchanger, a second inlet fluidly coupled to an output of the second side of the heat exchanger, and a common outlet fluidly coupled to the suction input of the one or more transcritical compressors; and a controller configured to perform operations comprising modulating the three-way valve of the valve system to control a flow of gas refrigerant from the evaporator outlet to the second side of the heat exchanger based on one or more characteristics of refrigerant in the refrigeration system.

2. The transcritical refrigeration system of claim 1, wherein the operations comprise controlling a superheat of the refrigerant to at least one of the one or more transcritical compressors.

3. The transcritical refrigeration system of claim 1, wherein the operations comprise controlling a flow of refrigerant through the second side of the heat exchanger to superheat at least a portion of the refrigerant circulating through the second side of the heat exchanger.

4. The transcritical refrigeration system of claim 1, wherein the operations comprise controlling a flow of refrigerant through the second side of the heat exchanger based on one or more characteristics of refrigerant in the refrigeration system.

5. The transcritical refrigeration system of claim 1, wherein the operations comprise:

determining whether one or more first operating parameters are within a first operating range; and in response to a determination that the one or more first operating parameters are within the first operating range, modulating at least one of the one or more valves of the valve system to control a flow of gas refrigerant from the evaporator outlet to the second side of the heat exchanger.

6. The transcritical refrigeration system of claim 1, further comprising a junction between the evaporator outlet and an outlet of the gas bypass valve between the evaporator outlet and a first inlet of the heat exchanger, wherein the heat exchanger is configured to receive a mixture of refrigerant from the outlet of the gas bypass valve and the at least one evaporator outlet.

7. The transcritical refrigeration system of claim 1, wherein an outlet of the gas bypass valve is fluidly coupled to the suction input of at least one of the transcritical compressors.

8. The transcritical refrigeration system of claim 1, wherein the refrigerant comprises carbon dioxide.

9. A transcritical refrigeration system, comprising:

a gas cooler/condenser;

a receiver configured to collect refrigerant produced by the refrigeration system and comprising a receiver outlet through which the gas refrigerant exits the receiver;

a high-pressure control valve configured to control a flow of refrigerant from the cooler/condenser to the receiver;

a gas bypass valve fluidly coupled to the receiver outlet and operable to control a pressure of the refrigerant in the receiver by controlling a flow of the gas refrigerant from the receiver through the gas bypass valve;

a cooling subsystem, comprising:

one or more expansion valves;

one or more evaporators, at least one of the one or more evaporators comprising an evaporator outlet; and a suction group comprising one or more transcritical compressors operable to compress gas refrigerant and discharge the compressed gas refrigerant into a discharge line;

a superheat control system, comprising:

at least one heat exchanger comprising a first side configured to carry gas refrigerant passing between the gas cooler/condenser and an inlet of the high-pressure control valve; and a second side in heat transfer communication with the first side and comprising a second side inlet and a second side outlet, the second side inlet in being in fluid communication with, and at substantially the same operating pressure as, the evaporator outlet of at least one the evaporators;

a valve system comprising one or more valves, the valve system configured to route gas refrigerant from the evaporator outlet of the at least one evaporator such that at least a portion of the gas refrigerant from the evaporator outlet passes through the second side of the heat exchanger and to a suction input of at least one of the one or more transcritical compressors of the suction group, the one or more valves comprising a three-way valve configured to control a flow of the gas refrigerant through the second side of the heat exchanger, the three-way valve comprising:

a first inlet fluidly coupled to the second side inlet of the heat exchanger, a second inlet fluidly coupled to the second side outlet of the heat exchanger, and a common outlet fluidly coupled to the suction input of the one or more transcritical compressors; and a controller configured to perform operations comprising:

determining that one or more first operating parameters are within a first operating range; and in response to a determination that the one or more first operating parameters are within the first operating range, modulating the three-way valve of the valve system to control a flow of gas refrigerant from the evaporator outlet to the inlet of the second side.

10. The transcritical refrigeration system of claim 9, wherein the operations comprise controlling a superheat of refrigerant to at least one of the one or more transcritical compressors.

11. The transcritical refrigeration system of claim 9, wherein the cooling system comprises a medium temperature subsystem.

12. The transcritical refrigeration system of claim 9, wherein the refrigerant comprises carbon dioxide.

13. A method of operating a transcritical refrigeration system, comprising:

compressing a refrigerant in one in one or more transcritical compressors in a suction group of the transcritical refrigeration system;

circulating the refrigerant from an outlet of at least one of the one or more transcritical compressors through a gas cooler/condenser;

circulating the refrigerant from an outlet of gas cooler/condenser through a first side of a heat exchanger;

collecting a portion of the refrigerant from an outlet of the first side of the heat exchanger into a receiver;

controlling a pressure of the refrigerant in the receiver by controlling a flow of gas refrigerant from the receiver through a gas bypass valve;

circulating liquid refrigerant from the receiver through one or more evaporators in a cooling subsystem of the refrigeration system;

circulating the refrigerant from an evaporator outlet of at least one of the evaporators through a second side of the heat exchanger such that heat is transferred from the refrigerant in the first side of the heat exchanger to refrigerant in the second side of the heat exchanger;

circulating at least a portion of the refrigerant from the second side of the heat exchanger to a suction input of at least one of the one or more transcritical compressors; and controlling a three-way valve to modulate a flow of refrigerant through the second side of the heat exchanger, the three-way valve comprising:

a first inlet fluidly coupled to a second side inlet of the second side of the heat exchanger, a second inlet fluidly coupled to a second side outlet of the second side of the heat exchanger, and a common outlet fluidly coupled to the suction input of the one or more transcritical compressors.

14. The method of claim 13, wherein the cooling subsystem is a medium temperature subsystem.

15. The method of claim 13, comprising controlling a flow of refrigerant through the second side of the heat exchanger to superheat at least a portion of the refrigerant circulating through the second side of the heat exchanger.

16. The method of claim 13, comprising controlling a flow of refrigerant through the second side of the heat exchanger based on one or more characteristics of refrigerant in the refrigeration system.

17. The method of claim 16, wherein controlling a flow of refrigerant through the second side of the heat exchanger comprises modulating the valve system to maintain a set-point of one or more characteristics of refrigerant between the second side of the heat exchanger and the suction input.

18. The method of claim 16, comprising measuring a temperature of refrigerant between an output of the second side of the heat exchanger and the suction input of the one or more transcritical compressors, wherein the flow of refrigerant through the second side of the heat exchanger is controlled at least in part based on the measured temperature.

19. The method of claim 13, comprising controlling a flow of refrigerant through the second side of the heat exchanger based at least in part on a measured temperature of refrigerant in the refrigeration system.

20. The method of claim 13, comprising controlling a flow of refrigerant through the second side of the heat exchanger based at least in part on a measured pressure of refrigerant in the refrigeration system.

21. The method of claim 13, comprising:

mixing refrigerant from an output of the gas bypass valve with the refrigerant from the evaporator output, and circulating at least a portion of the mixed refrigerant through the second side of the heat exchanger.

22. The method of claim 21, comprising controlling the flow through the second side of the heat exchanger at least in part by modulating the gas bypass valve.

23. The method of claim 13, wherein the refrigerant comprises carbon dioxide.

24. The transcritical refrigeration system of claim 2, wherein the operations comprise controlling a flow of refrigerant through the second side of the heat exchanger to superheat at least a portion of the refrigerant circulating through the second side of the heat exchanger.

25. The transcritical refrigeration system of claim 2, wherein the operations comprise controlling a flow of refrigerant through the second side of the heat exchanger based on one or more characteristics of refrigerant in the refrigeration system.

26. The transcritical refrigeration system of claim 2, wherein the operations comprise:

determining whether one or more first operating parameters are within a first operating range; and in response to a determination that the one or more first operating parameters are within the first operating range, modulating at least one of the one or more valves of the valve system to control a flow of gas refrigerant from the evaporator outlet to the second side of the heat exchanger.

* * * * *